US009229383B2

(12) United States Patent
Morishita

(10) Patent No.: US 9,229,383 B2
(45) Date of Patent: Jan. 5, 2016

(54) IMAGE FORMING APPARATUS, CONTROL APPARATUS, AND CONTROL METHODS THEREOF

(71) Applicant: CANON KABUSHIKI KAISHA, Tokyo (JP)

(72) Inventor: Yusuke Morishita, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/631,063

(22) Filed: Feb. 25, 2015

(65) Prior Publication Data

US 2015/0253702 A1 Sep. 10, 2015

(30) Foreign Application Priority Data

Mar. 5, 2014 (JP) ..... 2014-043154

(51) Int. Cl.
*G03G 15/20* (2006.01)
*G03G 15/36* (2006.01)

(52) U.S. Cl.
CPC ..... *G03G 15/2039* (2013.01); *G03G 15/36* (2013.01)

(58) Field of Classification Search
CPC ..... G03G 15/36; G03G 2215/0426; G03G 2215/0468
See application file for complete search history.

(56) References Cited

U.S. PATENT DOCUMENTS 8,886,107 B2 * 11/2014 Tamura ..... 399/335
2011/0090527 A1 * 4/2011 Nakashio ..... 358/1.14
2014/0369707 A1 * 12/2014 Imine ..... 399/69

FOREIGN PATENT DOCUMENTS

JP 06-110354 A 4/1994
JP 2010033419 A * 2/2010

* cited by examiner

*Primary Examiner* — Clayton E LaBalle
*Assistant Examiner* — Leon W Rhodes, Jr.
(74) *Attorney, Agent, or Firm* — Fitzpatrick, Cella, Harper & Scinto

(57) ABSTRACT

An image forming apparatus composes an input image and a form image and generates a composite image, determines whether the image composition processing is designated, and determines whether the maximum amount of applied toner of the form image is not less than a predetermined threshold. Then, the apparatus sets an amount of applied toner of the form image as the amount of applied toner of the composite image if the image composition processing is designated and the maximum amount of applied toner of the form image is not less than the predetermined threshold, and controls, based on a fixing temperature that is determined based on the amount of applied toner, the fixing temperature when performing fixing processing for a printing medium with a toner image that is formed based on the composite image.

11 Claims, 14 Drawing Sheets

IMAGE FORMING APPARATUS, CONTROL APPARATUS, AND CONTROL METHODS THEREOF

BACKGROUND OF THE INVENTION

1. Field of the Invention

The present invention relates to control of fixing an image formed by an electrophotographic method.

2. Description of the Related Art

In an image forming apparatus that thermally fixes, on transfer paper, a toner image formed by an electrophotographic method, in general, the fixing temperature of a fixing device is determined in accordance with the amount of applied toner per unit area on the transfer paper. For example, the maximum value of the amount of applied toner per unit area is determined in advance, and the temperature of the fixing device is adjusted so as to obtain a fixing temperature capable of reliably fixing an image having the maximum value. Recently, however, power consumption is required to be lower because of growing environmental awareness. When the amount of applied toner changes depending on the image of the page to be output, it is necessary to perform energy-saving fixing temperature control capable of adjustment to a temperature at which reliable fixing can be performed on a page basis.

The image forming apparatus may use an image composition function (to be referred to as image composition hereinafter) of composing an image with a form image stored in advance and outputting a composite image. The form image is generated in advance by, for example, scanning an image printed on paper and stored in a storage device such as an HDD in advance. When such image composition is performed for read data of an original, the amount of applied toner of the image after image composition is different from the amount of applied toner calculated from the read data. Hence, to perform more appropriate fixing temperature control, the image composition needs to be taken into consideration. Japanese Patent Laid-Open No. 6-110354 (patent literature 1) discloses a technique that prepares two fixing units of different set temperatures, and when using image composition, performs fixing using the fixing unit of the higher set temperature.

However, employing the arrangement including two fixing units to obtain an appropriate fixing temperature, as described in patent literature 1, leads to an increase in the size or cost of the image forming apparatus. For this reason, when performing image composition, it is preferable to detect the amount of applied toner of the image after image composition and control the temperature of the fixing unit. In general, however, the load of applied toner amount calculation processing is heavy, and performance is expected to be low when the processing is implemented by software processing.

SUMMARY OF THE INVENTION

According to one aspect of the present invention, an image forming apparatus of an electrophotographic type, comprises: an image composition unit configured to compose an input image and a form image and generate a composite image; a determination unit configured to determine whether the image composition processing by the image composition unit is designated; a threshold determination unit configured to determine whether the maximum amount of applied toner of the form image is not less than a predetermined threshold; a setting unit configured to set an amount of applied toner of the form image as the amount of applied toner of the composite image if the determination unit determines that the image composition processing by the image composition unit is designated, and the threshold determination unit determines that the maximum amount of applied toner of the form image is not less than the predetermined threshold; and a control unit configured to control, based on a fixing temperature determined based on the amount of applied toner set by the setting unit, the fixing temperature when performing fixing processing for a printing medium with a toner image formed based on the composite image.

The present invention makes it possible to appropriately adjust the fixing temperature according to the amount of applied toner even when performing image composition.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Preferred embodiments of the present invention will now be described in detail with reference to the accompanying drawings. Note that the following embodiments are merely examples and are not intended to limit the technical scope of the present invention.

First Embodiment

A tandem color image forming apparatus will be exemplified below as an image forming apparatus according to the first embodiment of the present invention.

System Configuration

Figure 1:
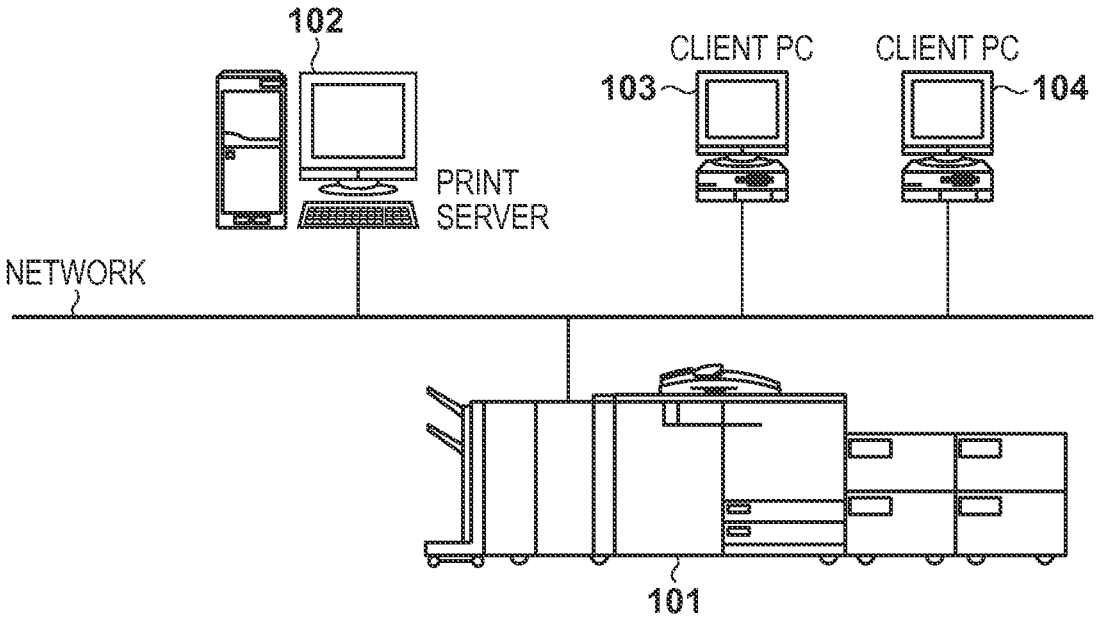
FIG. 1 is a view showing a system configuration including an image forming apparatus according to the first embodiment.

FIG. 1 is a view showing a system configuration including an electrophotographic image forming apparatus 101 according to the first embodiment.

The image forming apparatus 101 processes various kinds of input data, forms images on a printing medium such as a paper sheet, and outputs a printed product. A print server 102 is connected to the image forming apparatus 101 via a network. Client PCs 103 and 104 are connected to the image forming apparatus 101 via the network, like the print server 102.

Figure 2:
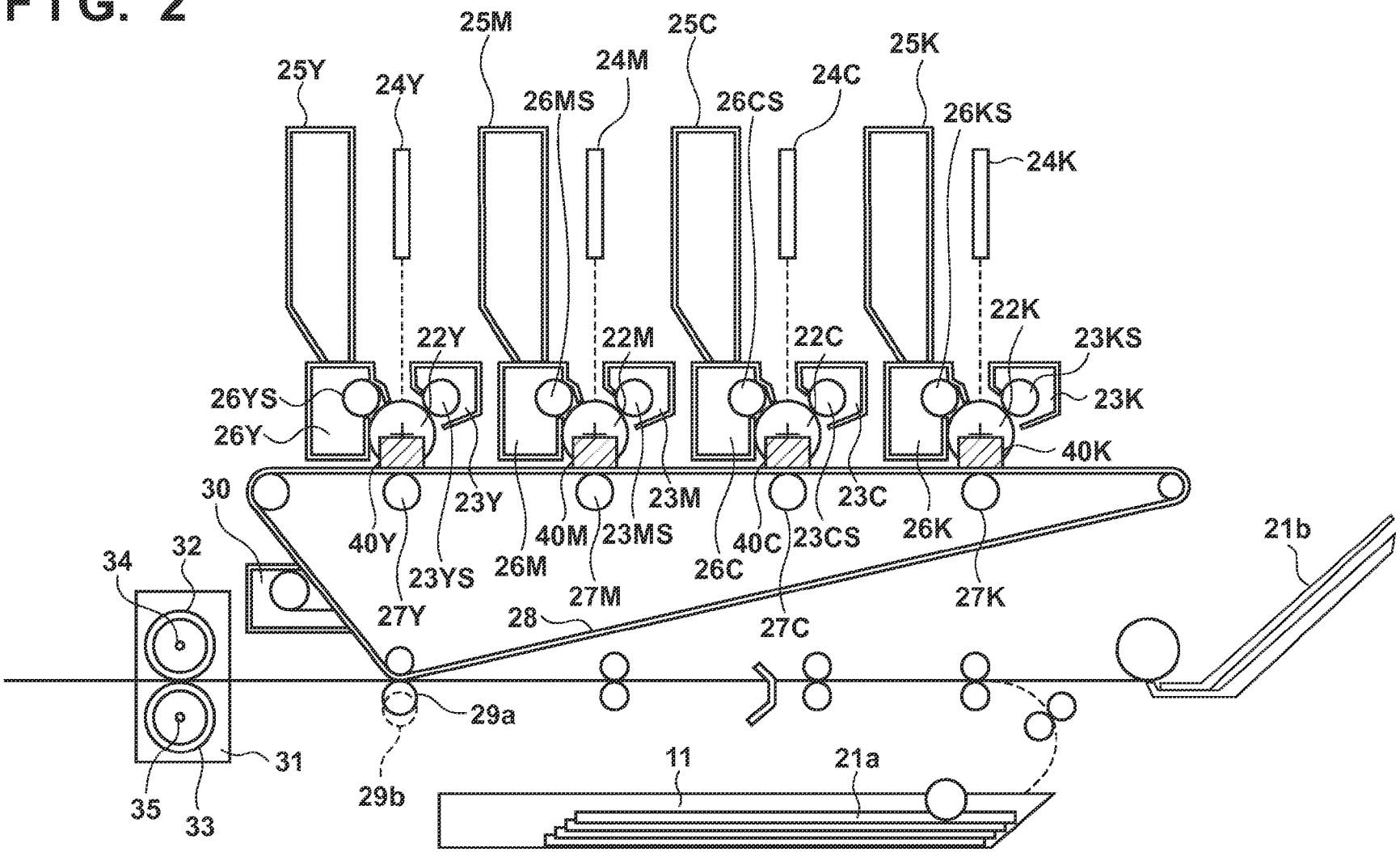
FIG. 2 is a sectional view of a tandem color image forming apparatus.

FIG. 2 is a sectional view of the tandem color image forming apparatus 101. The tandem color image forming apparatus 101 performs image formation by transferring a toner image onto a printing medium 11 via an intermediate transfer material 28.

A charging unit includes photosensitive members 22Y, 22M, 22C, and 22K, and four charge injectors 23Y, 23M, 23C, and 23K configured to charge the respective photosensitive members for yellow (Y), magenta (M), cyan (C), and black (K) toner.

The photosensitive members 22Y, 22M, 22C, and 22K rotate upon receiving driving forces transmitted from driving motors 40Y, 40M, 40C, and 40K, respectively. Referring to FIG. 2, the driving motors rotate the photosensitive members 22Y, 22M, 22C, and 22K, respectively, counterclockwise in accordance with an image forming operation.

An exposure unit irradiates the photosensitive members 22Y, 22M, 22C, and 22K with exposure light using scanner units 24Y, 24M, 24C, and 24K, respectively, and selectively exposes the surfaces of the photosensitive members 22Y, 22M, 22C, and 22K. Electrostatic latent images are thus formed on the photosensitive members.

A developing unit includes four developers 26Y, 26M, 26C, and 26K that perform development for Y, M, C, and K toners, respectively, to visualize the electrostatic latent images on the photosensitive members. The developers are provided with sleeves 26YS, 26MS, 26CS, and 26KS, respectively. Note that the developers 26 are detachable.

A transfer unit transfers a single-color toner image from each photosensitive member 22 onto the intermediate transfer material 28. In FIG. 2, the intermediate transfer material 28 rotates clockwise. The single-color toner images are sequentially transferred onto the intermediate transfer material 28 as the photosensitive members 22Y, 22M, 22C, and 22K and primary transfer rollers 27Y, 27M, 27C, and 27K located on opposing sides rotate. This is called primary transfer. Note that when an appropriate bias voltage is applied to the primary transfer rollers 27Y, 27M, 27C, and 27K, and the photosensitive members 22Y, 22M, 22C, and 22K and the intermediate transfer material 28 are caused to have different rotation speeds, the single-color toner image can efficiently be transferred onto the intermediate transfer material 28.

The transfer unit also overlays the single-color toner images on the intermediate transfer material 28, and conveys the overlaid multicolor toner image to a secondary transfer roller, shown in FIG. 2, positionable at positions 29*a* and 29*b*, as the intermediate transfer material 28 rotates. In addition, the printing medium 11, such as a paper sheet, is conveyed from a paper feed tray to the secondary transfer roller in a sandwiched state, and the multicolor toner image on the intermediate transfer material 28 is transferred onto the printing medium 11. At this time, an appropriate bias voltage is applied to the secondary transfer roller, and the toner image is electrostatically transferred. This is called secondary transfer. The secondary transfer roller contacts the printing medium 11 at the position 29*a* during transfer of the multicolor toner image onto the printing medium 11, and separates to the position 29*b* after print processing.

A fixing unit is a functional unit that fuses and fixes, to the printing medium 11, the multicolor toner image transferred onto the printing medium 11. For this purpose, the fixing unit includes a fixing roller 32 that heats the printing medium 11, and a pressurizing roller 33 that presses the printing medium 11 against the fixing roller 32. The fixing roller 32 and the pressurizing roller 33 are formed to be hollow and incorporate heaters 34 and 35, respectively. A fixing device 31 causes the fixing roller 32 and the pressurizing roller 33 to convey the printing medium 11 holding the multicolor toner image, and applies heat and pressure, thereby fixing the toner to the printing medium 11.

Note that a temperature sensor (not shown) is attached to the fixing unit, and the fixing unit is controlled to perform a fixing operation only when a temperature sufficient for fixing is confirmed. After that, the printing medium 11 after toner fixing is discharged to a discharge tray (not shown) by a discharge roller (not shown), and the image forming operation ends.

A cleaning unit 30 cleans toners remaining on the intermediate transfer material 28. Waste toners remaining after the four-color toner image formed on the intermediate transfer material 28 is transferred onto the printing medium 11 are removed from the intermediate transfer material 28 by cleaning and stored in a cleaner container.

Arrangement of Image Forming Apparatus

Figure 3:
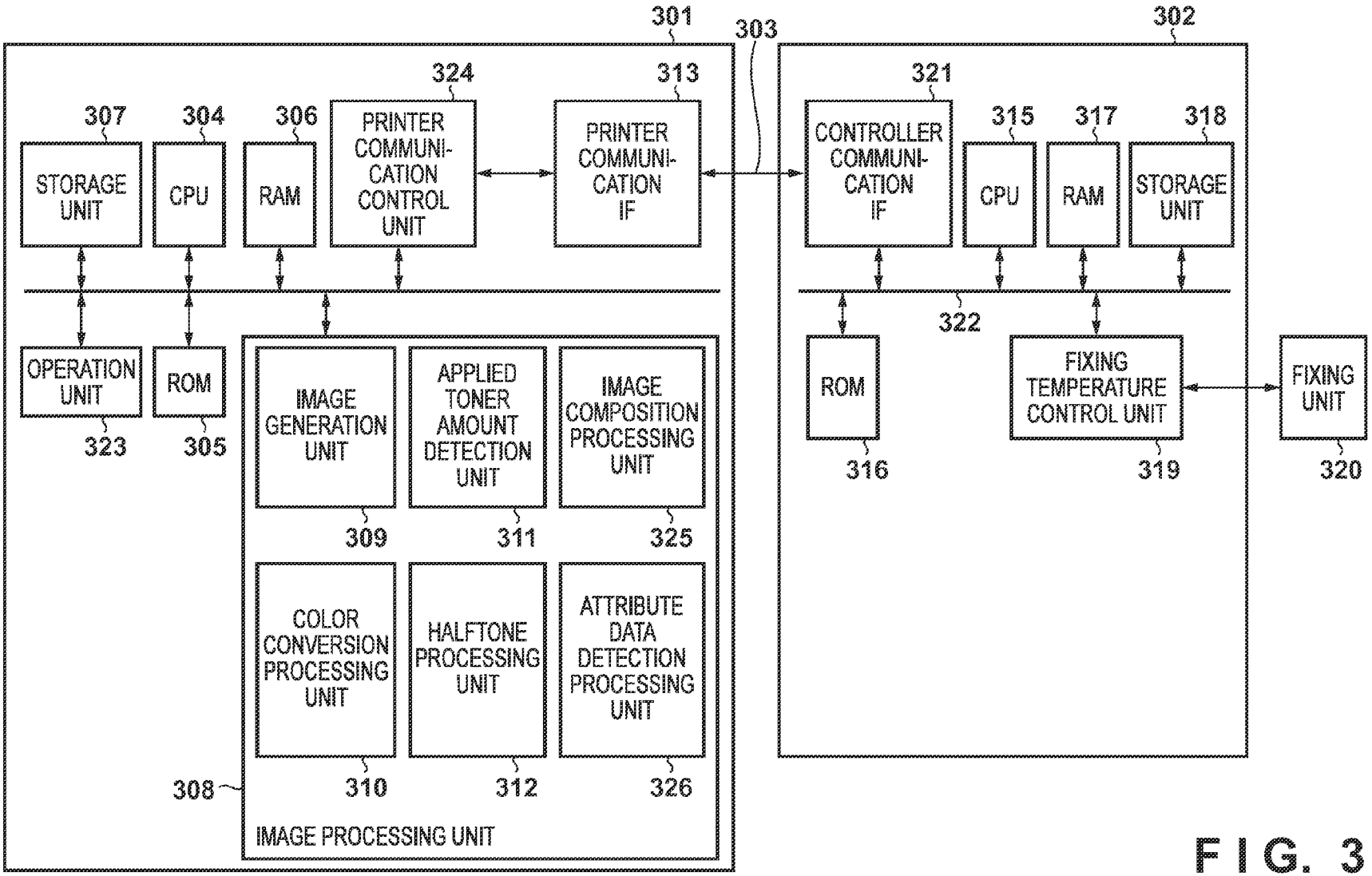
FIG. 3 is a block diagram of the arrangement of the image forming apparatus.

FIG. 3 is a block diagram of the arrangement of the image forming apparatus 101. The image forming apparatus 101 is roughly divided into a controller unit 301 (image processing unit) and a print unit 302 (image forming unit). The controller unit 301 is a functional unit that receives print data from an external apparatus and generates image data (raster image data) to be provided to the print unit 302. The print unit 302 is a functional unit that forms an image on a printing medium, such as a paper sheet, based on the image data received from the controller unit 301.

Each of the controller unit 301 and the print unit 302 includes a CPU configured to execute programs, a ROM, and a RAM. Each CPU reads out a main program from the ROM and stores it in the RAM in accordance with an initial program stored in the ROM. The RAM is used to store programs or as the main memory for work.

An image generation unit 309 generates printable raster image data based on print data (print job) received from the client PC 103 or the like. The raster image data includes RGB data and attribute data representing the data attribute of each pixel. The image generation unit 309 may handle image data read by a reading unit (scanner) installed in the image forming apparatus 101 itself. The reading unit here can be a CCD (Charged Couple Device) reading unit or a CIS (Contact Image Sensor) reading unit. A processing unit that performs predetermined image processing for the read image data may also be provided. The image forming apparatus 101 may be configured to receive image data from an external reading unit via an interface (not shown), instead of including the reading unit in itself.

A color conversion processing unit 310 converts RGB data into CMYK in accordance with the toner colors, and generates CMYK data. At this stage, the image data represents toner amounts of CMYK, and is expressed by, for example, values of 0 to 255 (8-bit value) on a pixel basis. For example, if the values of all colors are "0", this represents disuse of toners. The larger the value, the higher the density. A value "255" represents the highest density.

An applied toner amount detection unit 311 detects (derives) the amount of applied toner from the CMYK data generated by the color conversion processing unit 310. In the following explanation, the amount of applied toner is expressed as a ratio (unit:%) to the maximum value of the toner weight per unit area as 100%. For each color on a pixel basis, a value "255" corresponds to an amount of applied toner of 100%. The sum of the amounts of applied toners of CMYK represents the amount of applied toner of the pixel.

For example, when two colors each having the maximum value (100%) are overlaid, the amount of applied toner of the pixel is 200%. Note that each color has tonality and can take a value within the range of 0% to 100%. For example, in an image that makes full use of four CMYK toners in a full-color print mode, the maximum amount of applied toner is large. On the other hand, for example, in a monochrome image using K toner alone, the maximum amount of applied toner is smaller. The applied toner amount detection unit 311 calculates the amount of applied toner per unit area of an entire page and detects its maximum value as applied toner amount information.

The halftone processing unit 312 performs halftone processing for each color of CMYK data generated by the color conversion processing unit 310. As a detailed arrangement, the halftone processing unit performs screen processing or error diffusion processing. In the screen processing, N-ary processing is performed using a plurality of predetermined dither matrices and input image data. In the error diffusion processing, N-ary processing is performed by comparing input image data with a predetermined threshold, and the difference between the input image data and the threshold at that time is diffused to peripheral pixels to be subsequently subjected to N-ary processing.

An image composition processing unit 325 is a functional unit that creates a composite image using the image (CMYK data) processed by the color conversion processing unit 310 and data of a form image stored in advance. An attribute data detection processing unit 326 performs detection processing of attribute information of image data. For example, the attribute data detection processing unit 326 detects each pixel of an image as one of a character, a line, an image, and background regions, and outputs attribute data.

An operation unit 323 is a functional unit that receives various settings from the user. Here, the operation unit 323 receives, as setting contents concerning the image composition function, data on whether to perform image composition processing and whether the mode is color or monochrome. The operation unit 323 may be configured to further receive selection of an image composition mode (entire image composition or transparent image composition), the transparency of a form image (in transparent image composition), and the like. The received setting information is transmitted to the image composition processing unit 325 and the applied toner amount detection unit 311.

A printer communication IF 313 and a controller communication IF unit 321 are IF units configured to perform communication between the controller unit 301 and the print unit 302. Information to be communicated here includes various kinds of control signals and applied toner amount information detected by the applied toner amount detection unit 311 as well as image data (raster image data) to be printed. A printer communication control unit 324 selects data to be transmitted from the printer communication IF 313 to the controller communication IF unit 321.

A fixing temperature control unit 319 calculates a target fixing temperature (for example, the minimum temperature necessary for fixing) in accordance with the applied toner amount information transferred from the controller unit 301 to the print unit 302. Note that a method of calculating, from the applied toner amount information, the minimum temperature necessary for fixing the page of the amount of applied toner will be described later with reference to FIG. 4. The fixing temperature control unit 319 then controls the temperature of the fixing unit 320 based on the calculated target fixing temperature.

Fixing Temperature Decision Based on Amount of Applied Toner

As described above, the amount of applied toner refers to a toner amount per unit area on an image. To fix toner on a printing medium without any fixing failure, the temperature of the fixing unit in fixing processing of a target page needs to be set to a fixing temperature capable of reliably fixing a pixel (or pixel block) having the maximum value of the amount of applied toner in the target page. Since the maximum amount of applied toner changes depending on image data to be printed, the temperature necessary for fixing also changes depending on the image data. More specifically, the larger the maximum amount of applied toner, the higher the necessary temperature.

Figure 4:
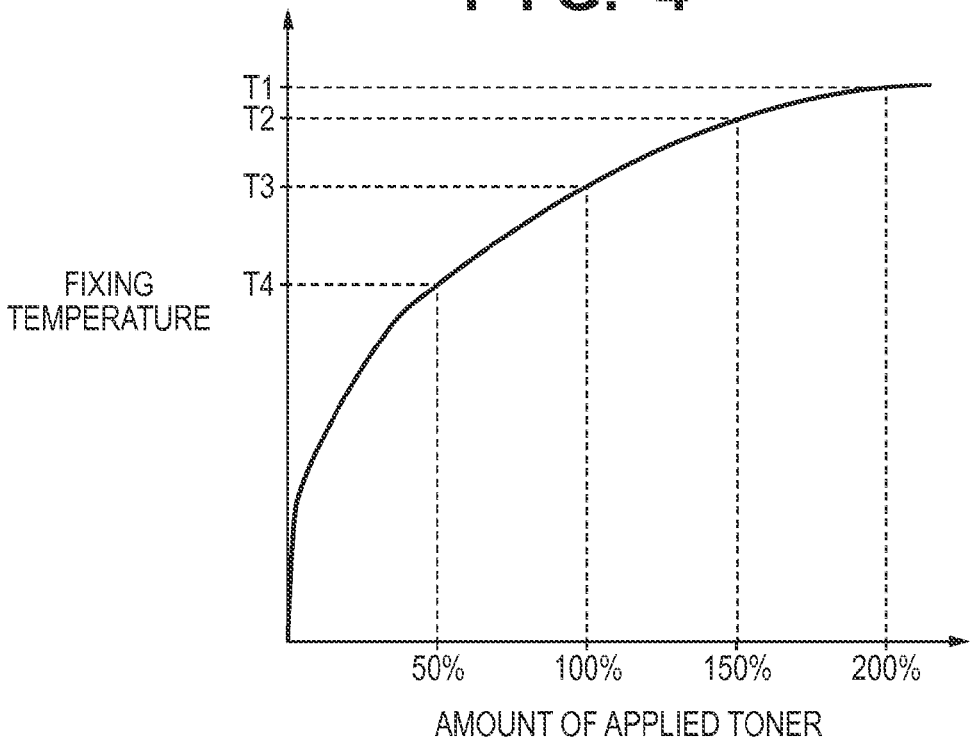
FIG. 4 is a graph showing the relationship between an amount of applied toner and a fixing temperature.

FIG. 4 is a graph showing the relationship between the amount of applied toner and the fixing temperature. The abscissa represents the amount of applied toner, and the ordinate represents the temperature necessary for fixing. For example, when the detection result of the applied toner amount detection unit is 200%, the minimum temperature necessary for fixing is T1. When the detection result is 100%, the minimum temperature necessary for fixing the target page is T3, as can be seen.

If the temperature has risen to the temperature capable of fixing the maximum amount of applied toner appearing in a print page, no problem, such as a fixing failure, occurs in the whole image. It is therefore possible to obtain the minimum temperature necessary for fixing a page to be output based on the applied toner amount information detected by the above-described applied toner amount detection unit.

Note that the relationship (temperature relationship data) shown in the graph of FIG. 4 is stored in a storage unit 307 or a RAM 306 as, for example, a lookup table (LUT) because it is used in temperature control of the fixing unit 320. The relationship shown in the graph of FIG. 4 may be stored after normalization to reduce the information amount.

Operation of Image Forming Apparatus

Figure 5:
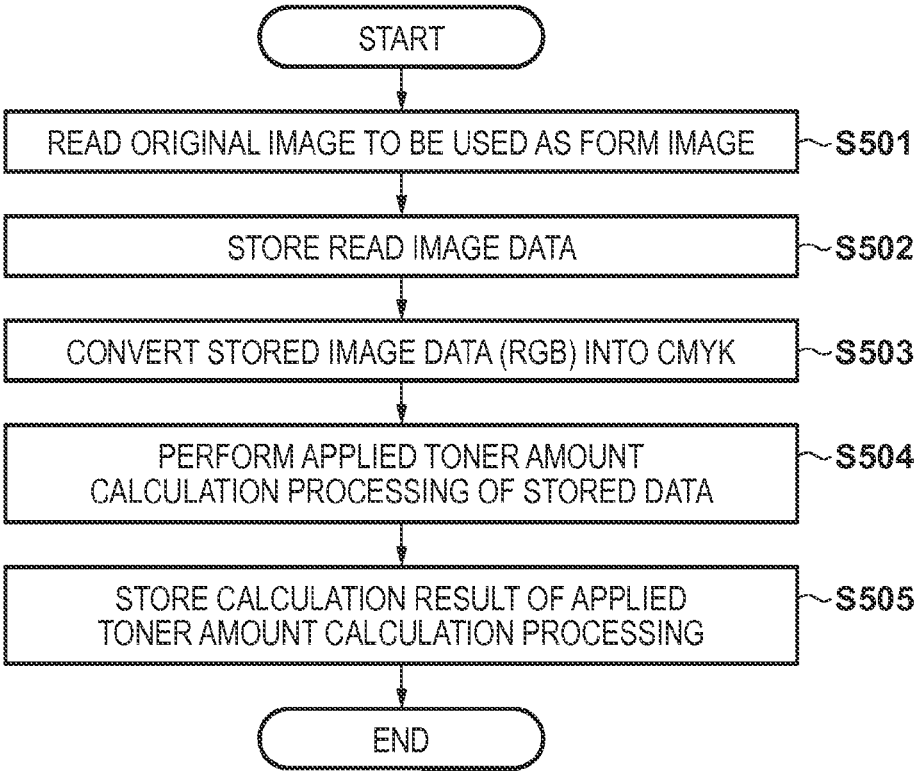
FIG. 5 is a flowchart of form image generation processing according to the first embodiment.

FIG. 5 is a flowchart of form image generation processing according to the first embodiment. The procedure shown in FIG. 5 is implemented by causing a CPU 304 to execute a control program and operate an image processing unit 308.

In step S501, the image generation unit 309 causes the above-described reading unit (scanner) to read an original to be used as a form image, and receives the image as image data (RGB data). In step S502, the image generation unit 309 stores the image data received in step S501 in the storage unit 307. In step S503, the color conversion processing unit 310 converts the RGB data stored in step S502 into CMYK data.

In step S504, the applied toner amount detection unit 311 calculates the amount of applied toner from the CMYK data obtained by conversion in step S503. In step S505, the applied toner amount detection unit 311 stores the applied toner amount information calculated in step S504 in the storage unit 307 in association with the corresponding image data.

Note that here, the amount of applied toner calculated based on applied toner amount detection is stored as applied toner amount information, as described above. However, not the calculated amount of applied toner itself, but other information may be stored as applied toner amount information. For example, if a fixing unit temperature corresponding to the calculated amount of applied toner is derived as a predetermined maximum temperature, flag information indicating that the fixing unit needs the maximum temperature may be stored as applied toner amount information.

Figure 6:
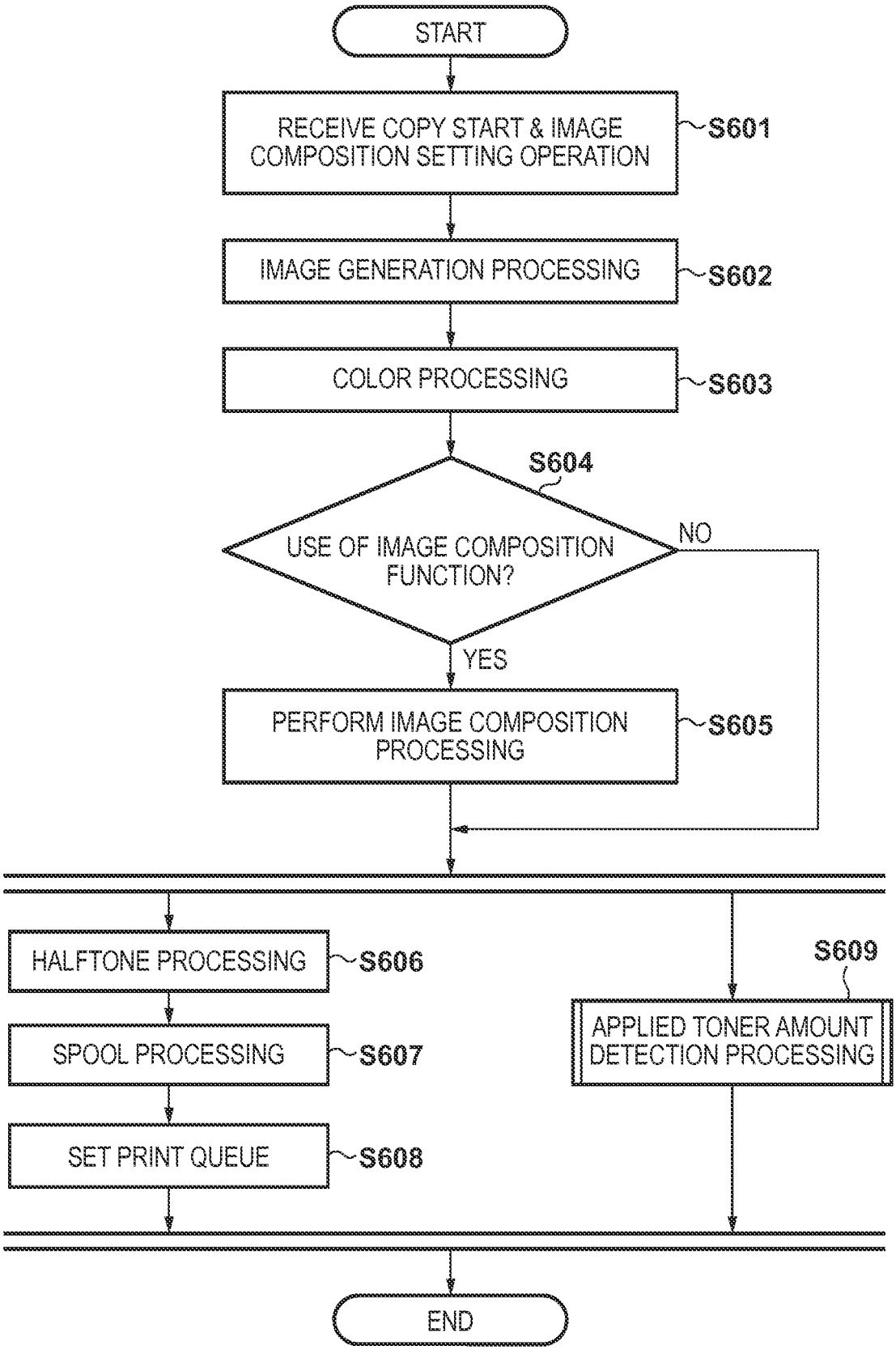
FIG. 6 is a flowchart of image data spool processing.

FIG. 6 is a flowchart of image data spool processing. More specifically, the controller unit 301 performs spool processing of print image data. Note that the procedure shown in FIG. 6 is implemented by causing the CPU 304 to execute a control program and operate the image processing unit 308.

In step S601, the operation unit 323 receives a copy start operation and image composition settings from the user. The received image composition set values are transmitted to the image composition processing unit 325 and the applied toner amount detection unit 311.

In step S602, the image generation unit 309 reads an original using the above-described reading unit and generates image data (RGB data). In step S603, the color conversion processing unit 310 performs CMYK conversion of the RGB data in accordance with toner colors to generate CMYK data.

In step S604, the image composition processing unit 325 determines, based on the information received from the operation unit 323, whether to perform image composition. To perform image composition, the process advances to step S605. Not to perform image composition (that is, to produce a normal copy), the process advances to steps S606 and S609.

In step S605, the image composition processing unit 325 creates a composite image using the CMYK data of the image data obtained by reading the original and data of a form image stored in advance. In step S606, the halftone processing unit 312 performs N-ary processing of the composite image by a method using screen processing or error diffusion processing, thereby generating print image data. In step S607, the CPU 304 performs spool processing of accumulating, in the RAM 306, the print image data generated in step S606.

In step S608, the CPU 304 registers, in a print queue 1101, "page information data" representing the print image data spooled in step S607. The print queue is implemented on the RAM 306. The page information data includes, for example, the ID, the image size, and the paper type of the print image data. Details of the print queue 1101 will be described later.

In step S609, the applied toner amount detection unit 311 performs applied toner amount detection processing in parallel to the processes of steps S606 to S608. Details will be described later with reference to FIG. 7.

Figure 7:
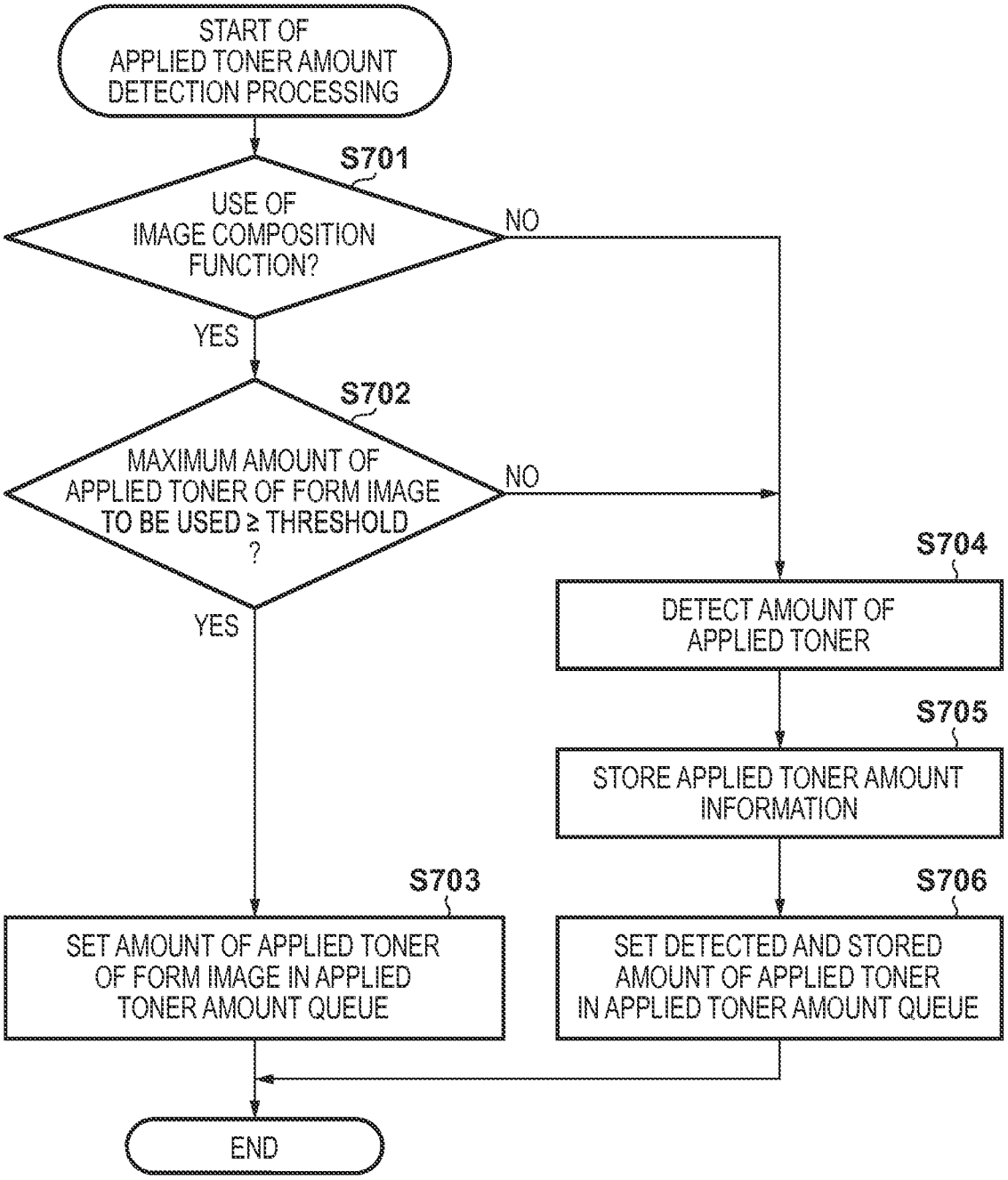
FIG. 7 is a flowchart of applied toner amount detection processing according to the first embodiment.

FIG. 7 is a flowchart of applied toner amount detection processing (step S609) according to the first embodiment. Note that the procedure shown in FIG. 7 is implemented by causing the CPU 304 to execute a control program and operate the applied toner amount detection unit 311.

In step S701, the applied toner amount detection unit 311 determines based on the information received from the operation unit 323 whether to perform image composition. To perform image composition, the process advances to step S702. Not to perform image composition (to produce a normal copy), the process advances to step S704.

In step S702, the applied toner amount detection unit 311 determines whether the amount of applied toner of the form image to be used for image composition designated by the setting information received from the operation unit 323 is equal to or larger than a predetermined threshold (threshold determination unit). Note that the amount of applied toner of the form image is assumed to be stored in the storage unit 307 in advance. If the amount of applied toner is determined to be equal to or larger than the predetermined threshold, the process advances to step S703. If the amount of applied toner is determined to be smaller than the predetermined threshold, the process advances to step S704.

In step S703, the applied toner amount detection unit 311 registers, in an applied toner amount queue 1102, "toner information data" representing the applied toner amount information of the form image corresponding to the form image designated by the setting information received from the operation unit 323. Note that the applied toner amount queue 1102 is implemented in the RAM 306 by causing the CPU 304 to execute a control program. The toner information data includes the ID of the print image data and the applied toner amount information of the form image. Note that although not illustrated, if flag information representing the necessity of maximum temperature setting for fixing is stored in step S505, the determination processing of step S702 is omitted, and the flag information is set in the queue in step S703. Details of the applied toner amount queue 1102 will be described later.

In step S704, the applied toner amount detection unit 311 inputs data after color conversion of step S603 in a normal copy mode, or inputs image data after image composition of step S605 when using image composition. The applied toner amount detection unit 311 then performs applied toner amount detection processing and generates applied toner amount information. In step S705, the applied toner amount detection unit 311 stores, in the RAM 306, the applied toner amount information generated in step S704.

In step S706, the CPU 304 registers, in the applied toner amount queue 1102, "toner information data" representing the applied toner amount information stored in step S705. As described above, the applied toner amount queue 1102 is implemented in the RAM 306 by causing the CPU 304 to execute a control program. The toner information data includes the ID and the applied toner amount information of the print image data. Details of the applied toner amount queue 1102 will be described later.

Figure 11A:
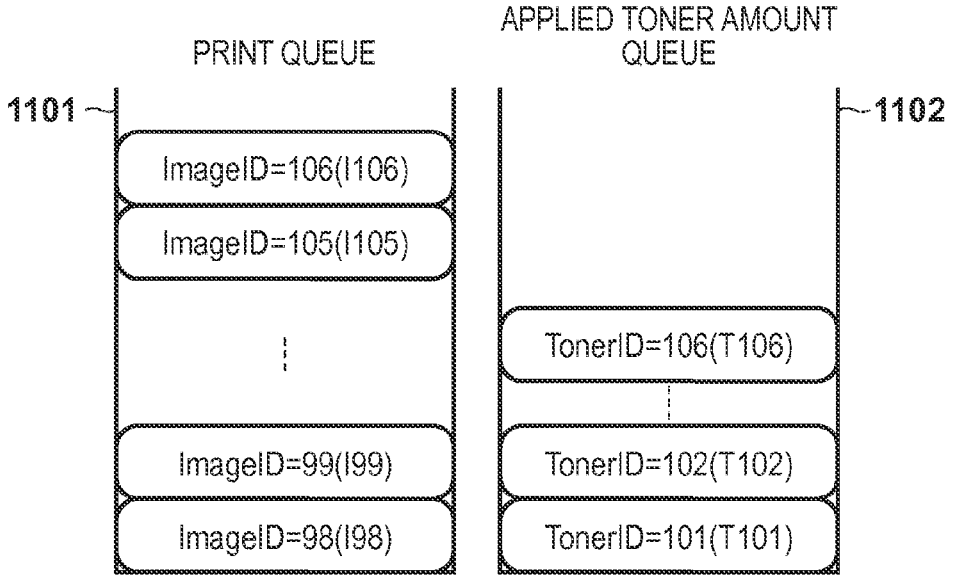
FIGS. 11A and 11B are views for explaining a print queue and an applied toner amount queue.
Figure 11B:
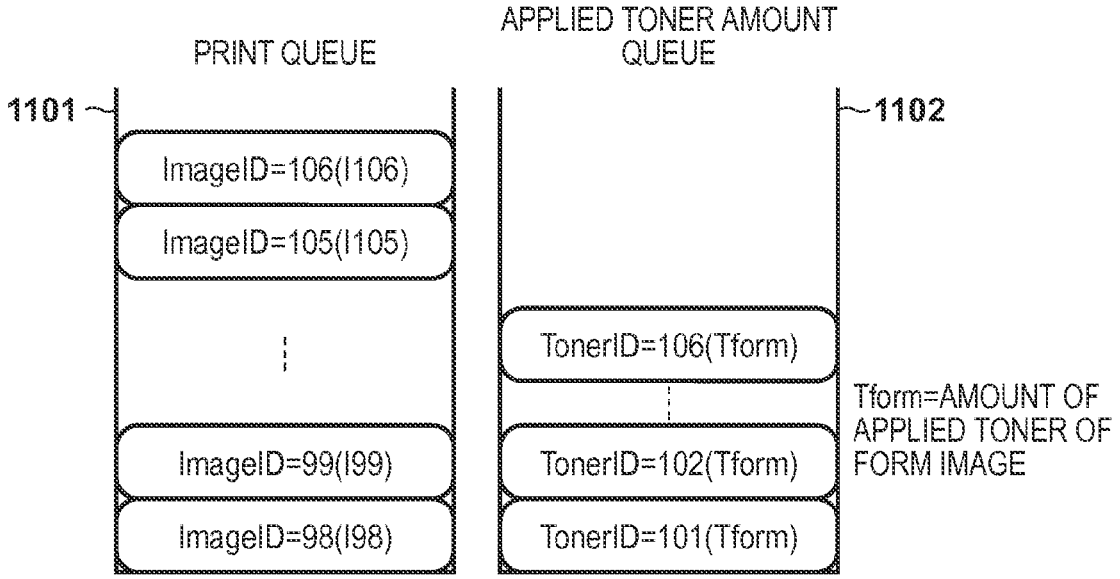

FIGS. 11A and 11B are views for illustrating the print queue and the applied toner amount queue. FIG. 11A exemplarily illustrates the print queue 1101 and the applied toner amount queue 1102 in a case where image composition is not performed or in a case where the amount of applied toner of the form image used for image composition is smaller than the threshold. FIG. 11B exemplarily illustrates the print queue 1101 and the applied toner amount queue 1102 in a case where image composition is performed or in a case where the amount of applied toner of the form image used is equal to or larger than the threshold.

As shown in FIGS. 11A and 11B, page information data generated by a print job or copy job are registered in the print queue 1101. Each of FIGS. 11A and 11B shows a state in which nine page information data (I98 to I106) generated based on jobs are registered in the print queue 1101. Here, a page number is handled as page information data. The data may include data representing the storage destination of page information corresponding to the ID.

As shown in FIG. 11A, when image composition is not performed, the toner information data (T101 to T106) of pages based on applied toner amount detection processing are registered in the applied toner amount queue 1102. A number included in each toner information data (ID) represents a page number and corresponds to page information data (ID) including the same number.

On the other hand, as shown in FIG. 11B, when image composition is performed, and the amount of applied toner of the form image is equal to or larger than the threshold, pieces of information of the amounts of applied toner (Tform) of form images stored in the storage unit 307 in advance are registered in the applied toner amount queue 1102. Here, the applied toner amount information itself is handled as toner information data. The information may include data representing the storage destination of applied toner amount information of each form image to be used. Alternatively, flag information, with which the necessity of setting of the maximum value of the fixing temperature can be determined, may be stored.

Note that three pieces of toner information data corresponding to three page information data (I98 to I100) are not illustrated in FIGS. 11A and 11B. This is because the toner information data corresponding to the pages are transmitted to the print unit 302 while preceding the corresponding page information data (I98 to I100) by three pages, and are therefore already deleted from the queue.

This is because a predetermined time lag (for example, corresponding to N pages) occurs until the temperature of the fixing unit actually reaches an optimum value after transmission of the applied toner amount information. For this reason, the ImageID number in the print queue and the TonerID number of the amount of applied toner are stored while being shifted by N pages, as shown in FIGS. 11A and 11B. That is, toner information data is transmitted while preceding page information data by N pages. Note that N=3 in FIG. 11A. However, the value N changes depending on the performance of the print unit 302, and the like. Hence, an arbitrary value can be set as N depending on the actual device configuration.

Immediately after the start of printing, when the temperature of the fixing unit is controlled after detecting the amount of applied toner, the image forming apparatus cannot immediately react to a print instruction from the user, resulting in low productivity. To prevent this, fixing temperature control is not performed for pages before a predetermined page after the start of printing, and fixing is performed at a fixing temperature capable of fixing a maximum amount of applied toner possible in the image forming apparatus 101. After that, the amount of applied toner is detected from print image data, and temperature control is performed.

Figure 8:
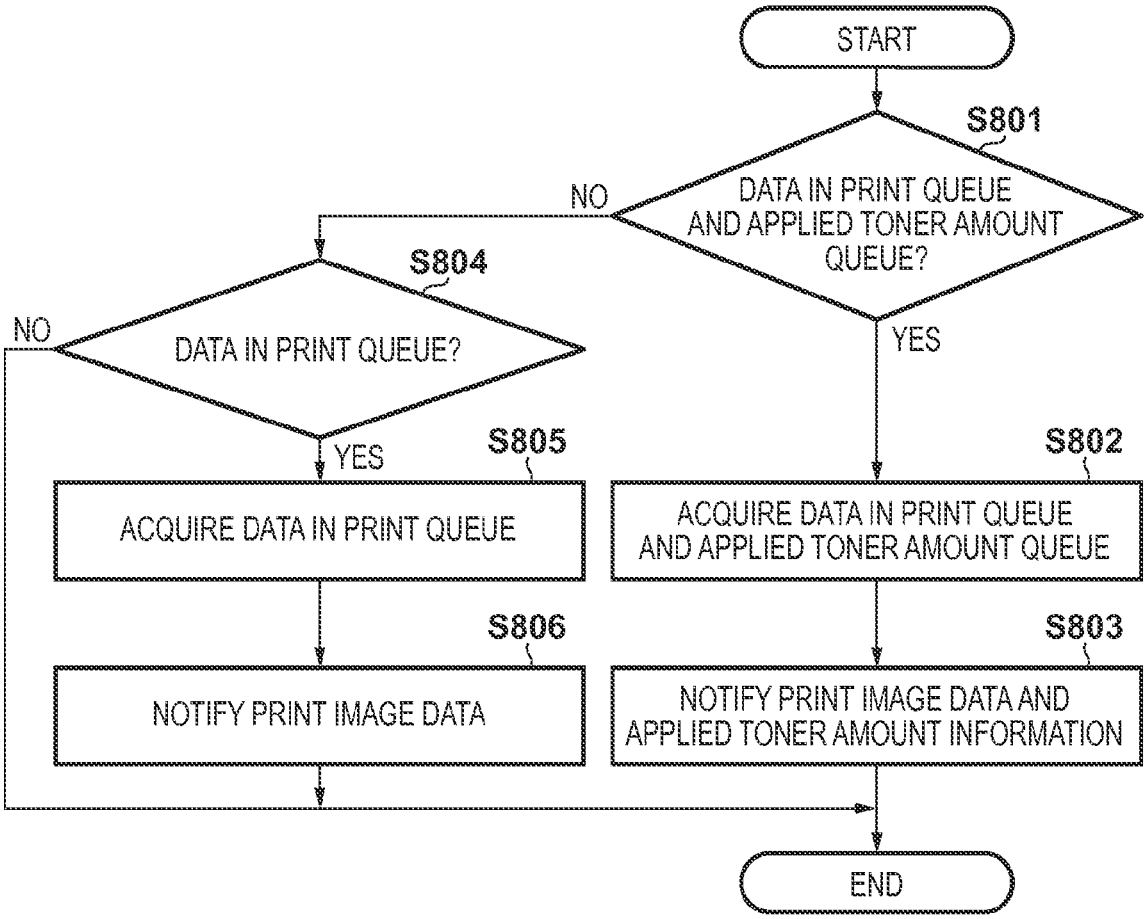
FIG. 8 is a flowchart of transfer control of print image data and applied toner amount information.

FIG. 8 is a flowchart of transfer control of print image data and applied toner amount information. Note that the procedure shown in FIG. 8 is implemented by causing the CPU 304 to execute a control program and operate the printer communication control unit 324.

In step S801, the printer communication control unit 324 confirms whether page information data and toner information data are stored in the print queue 1101 and the applied toner amount queue 1102. If both are stored, the process advances to step S802. Otherwise, the process advances to step S804.

In step S802, the printer communication control unit 324 acquires the page information data from the print queue 1101 and the toner information data from the applied toner amount queue 1102. When the data are acquired, the acquired data are discarded from the queues.

In step S803, the printer communication control unit 324 transfers the page information data and the toner information data acquired in step S802 to the print unit 302 via the printer communication IF 313 and a communication line 303.

In step S804, the printer communication control unit 324 confirms whether page information data are stored in the print queue 1101. If page information data are stored, the process advances to step S805. If no page information data are stored, the processing ends.

In step S805, the printer communication control unit 324 acquires the page information data from the print queue 1101. When the data are acquired, the acquired data are discarded from the queue.

In step S806, the printer communication control unit 324 transfers the page information data acquired in step S805 to the print unit 302 via the printer communication IF 313 and the communication line 303.

Figure 9:
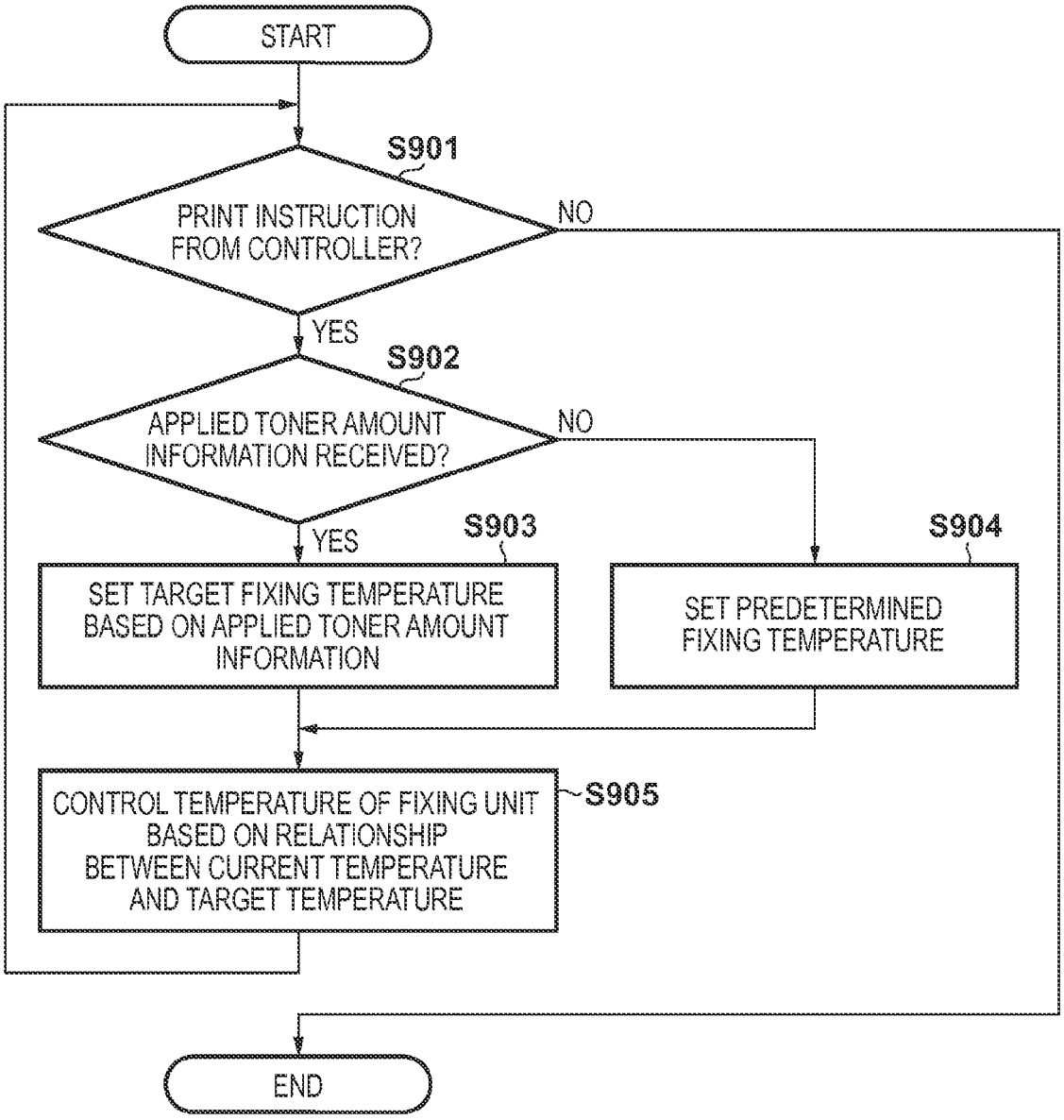
FIG. 9 is a flowchart of fixing temperature control based on applied toner amount information.

FIG. 9 is a flowchart of fixing temperature control based on applied toner amount information. Note that the procedure shown in FIG. 9 is implemented by causing a CPU 315 to execute a control program and operate the fixing temperature control unit 319.

In step S901, the fixing temperature control unit 319 determines whether a print instruction is received from the controller unit 301. If an instruction is received, the process advances to step S902. In step S902, the fixing temperature control unit 319 determines whether applied toner amount information is received. If no applied toner amount information is received, the process advances to step S904. If applied toner amount information is received, the process advances to step S903.

In step S903, the fixing temperature control unit 319 calculates the minimum temperature necessary for fixing a target page using, out of the received applied toner amount information, information of the page currently under printing to a predetermined page for which the fixing unit temperature can be set. Note that although not illustrated, if flag information representing the necessity of maximum temperature setting of the fixing temperature is set in the queue in step S703, the fixing temperature is set to the maximum value. In step S904, the fixing temperature control unit 319 sets a predetermined fixing temperature, for example, a temperature capable of fixing any print image data independently of its amount of applied toner. For example, a fixing temperature capable of fixing a maximum amount of applied toner is set.

In step S905, the fixing temperature control unit 319 controls the temperature of the fixing unit in consideration of the current fixing temperature and the fixing temperature of the control target page determined in step S903. More specifically, if it is necessary to reach the target temperature before the control target page, the temperature of the fixing unit is raised. If it is possible to lower the fixing temperature with respect to the target temperature, control of the process is performed to lower the temperature. After this control, the process returns to step S901, and the processing is repeated up to the end of pages. With the above-described processing, the fixing unit 320 can perform fixing at a fixing temperature suitable for each print image data.

Figure 10A:
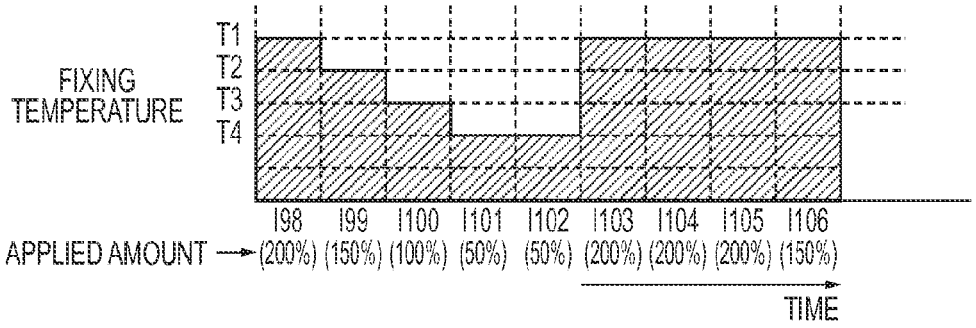
FIGS. 10A to 10C are graphs showing examples of temperature control of a fixing unit.
Figure 10B:
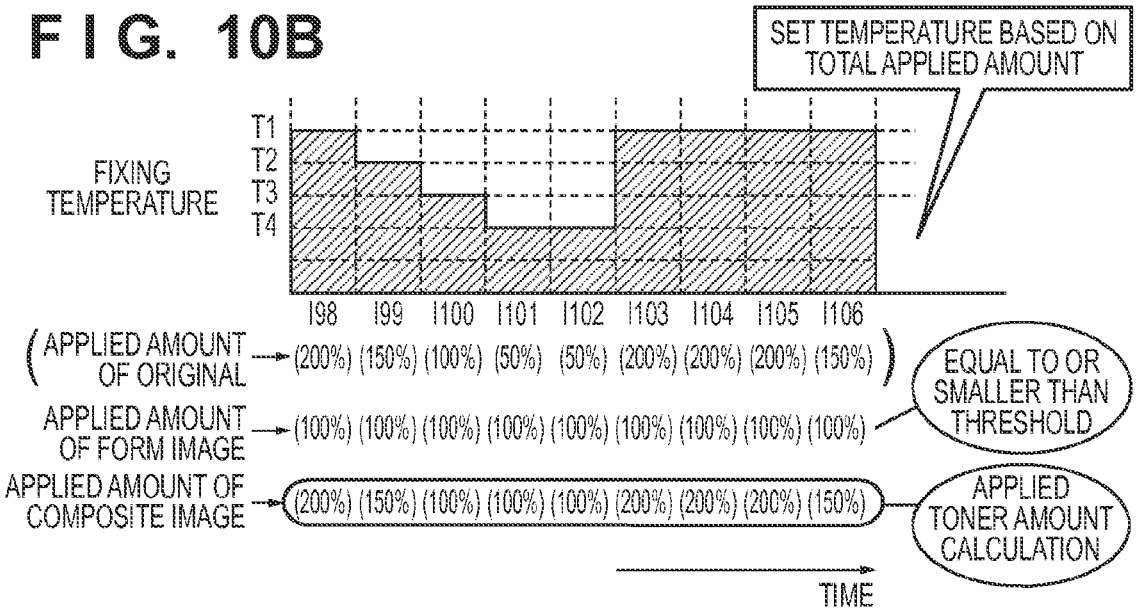
Figure 10C:
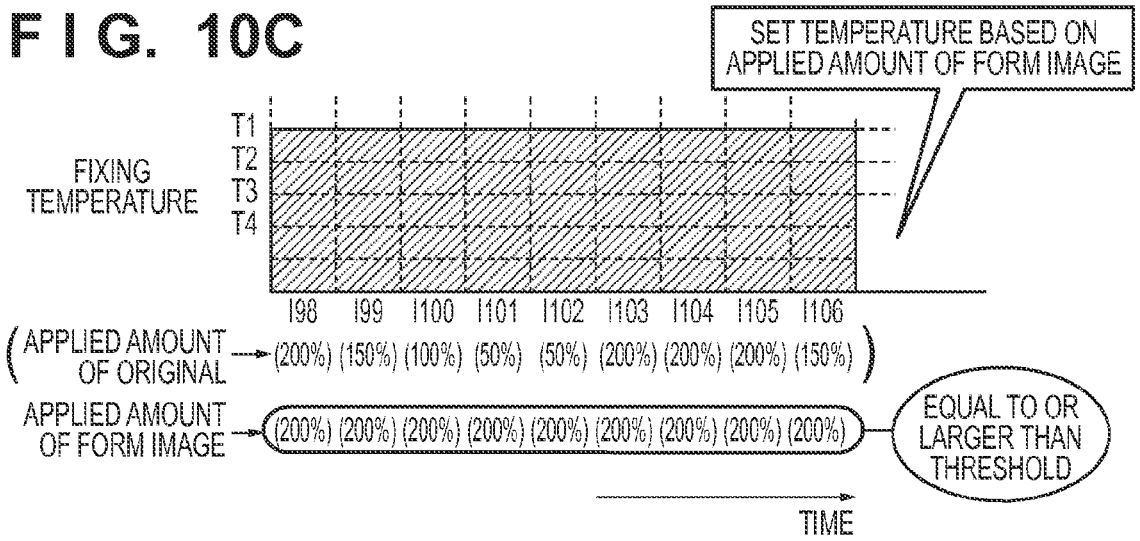

FIGS. 10A to 10C are graphs showing examples of temperature control of the fixing unit. The abscissa represents time, and the ordinate represents the fixing temperature when fixing print image data of each page. Note that the amount of applied toner is shown as a percentage under each page number. FIG. 10A shows an example in which the amounts of applied toner are 200% for the 98th and 103rd to 105th pages (page IDs=98, and 103 to 105), 150% for the 99th and 106th pages, 100% for the 100th page, and 50% for the remaining pages.

Here, the amount of applied toner and the minimum temperature necessary for fixing have the relationship as shown in FIG. 4. That is, the temperature necessary for fixing an image whose amount of applied toner is 200% is T1, the temperature necessary for fixing an image whose amount of applied toner is 150% is T2, the temperature necessary for fixing an image whose amount of applied toner is 100% is T3, and the temperature necessary for fixing an image whose amount of applied toner is 50% is T4.

First, pieces of toner applied amount information of a predetermined number of pages (here, three pages) are transferred to the fixing temperature control unit 319 in advance. Hence, at the point in time when given print data, for example, page 98 is fixed, the print unit 302 has already been notified of the toner applied amount information of at least pages 99, 100, and 101. For this reason, after page 98 is fixed, the fixing temperature can be lowered to the target temperature T2 of page 99.

FIG. 10B shows an example of the temperature of the fixing unit controlled when the image composition function is used, and the amount of applied toner of the form image is smaller than the threshold. When the amount of applied toner of the form image is smaller than the threshold (for example, less than 150%), the amount of applied toner of the composite image is detected (step S704), and the fixing temperature is adjusted by applied toner amount information based on the detection. Note that although FIG. 10B shows the amount of applied toner of the original for the sake of reference, calculation of the amount of applied toner of the original is not performed.

FIG. 10C shows an example of the temperature of the fixing unit controlled when the image composition function is used, and the amount of applied toner of the form image is equal to or larger than the threshold. When the amount of applied toner of the form image is equal to or larger than the threshold (for example, equal to or larger than 150%), the fixing temperature is adjusted based on the amount of applied toner of the form image independently of the amount of applied toner of the original. Note that although FIG. 10C shows the amount of applied toner of the original for the sake of reference, calculation of the amount of applied toner is not performed.

As described above, according to the first embodiment, when the image composition function is used, the fixing temperature can appropriately be controlled while reducing applied toner amount calculation processing. That is, when the amount of applied toner of the form image is equal to or larger than the threshold in image composition, the applied toner amount detection processing of the composite image is omitted, and the print unit is notified of a predetermined amount of applied toner corresponding to the form image, thereby implementing fixing temperature control while reducing the processing load of applied toner amount detection processing.

Second Embodiment

In the second embodiment, fixing temperature control applicable to "transparent image composition" for composing a form image through which an original image is visible will be described.

The image composition function has a "entire image composition" mode and a "transparent image composition" mode. The "entire image composition" is a method of composing a form image such that an original image located in the lower layer becomes invisible in a region where the form image and the original image overlap. On the other hand, the "transparent image composition" is a method of composing a form image while setting a halftone density (for example, 20% to 99%) for it, thereby making an original image located in the lower layer visible through the form image.

In the entire image composition mode, fixing temperature control can be performed by the same method as in the first embodiment. In the transparent image composition mode, however, appropriate temperature control may be impossible in some cases. For example, even when the amount of applied toner of a stored form image is equal to or larger than the threshold, appropriate temperature adjustment may be impossible if the amount of applied toner of the form image changes depending on the halftone density setting at the time of image composition. Fixing temperature control applicable to transparent image composition will be described below.

Note that the system configuration and the arrangement of the image forming apparatus are the same as in the first embodiment (FIGS. 1 to 3), and a description thereof will be omitted. Operations of the image forming apparatus different from the first embodiment will mainly be explained below.

Operation of Image Forming Apparatus

Processing for causing a controller unit 301 to store a form image to be used in the image composition function is the same as in the first embodiment (FIG. 5), and a description thereof will be omitted. Processing for causing the controller unit 301 to notify a print unit 302 of print image data and applied toner amount information is the same as in the first embodiment (FIG. 8), and a description thereof will be omitted. Fixing unit temperature control by the print unit is the same as in the first embodiment (FIG. 9), and a description thereof will be omitted. Processing up to spool processing of print image data by the controller unit 301 is the same as in the first embodiment (FIG. 6) except applied toner amount detection processing of step S609, and a description thereof will be omitted.

Figure 12:
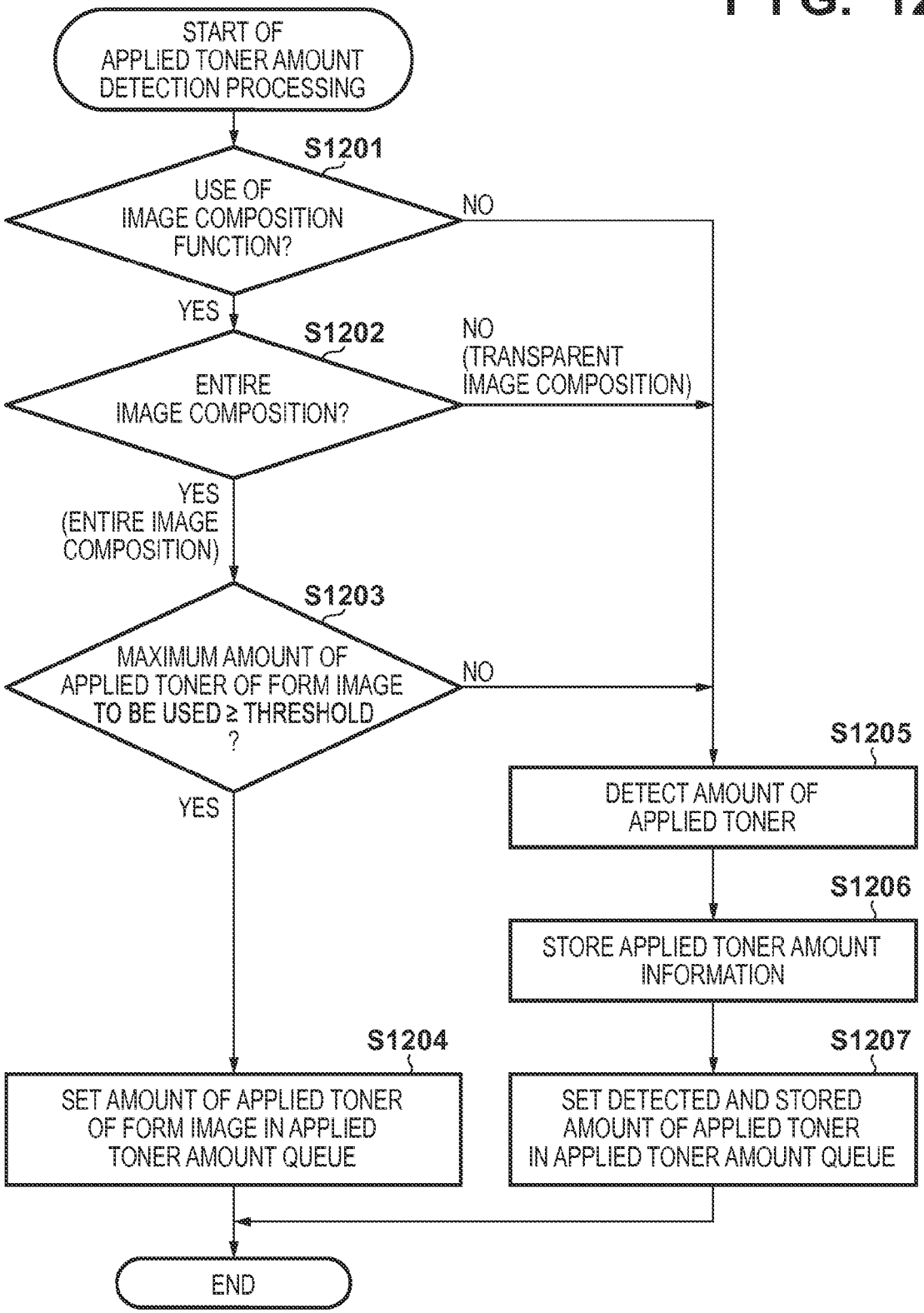
FIG. 12 is a flowchart of applied toner amount detection processing according to the second embodiment.

FIG. 12 is a flowchart of applied toner amount detection processing according to the second embodiment. Note that the procedure shown in FIG. 12 is implemented by causing the CPU 304 to execute a control program and operate an applied toner amount detection unit 311.

In step S1201, the applied toner amount detection unit 311 determines, based on information received from an operation unit 323, whether to perform image composition. To perform image composition, the process advances to step S1202. Not to perform image composition (to produce a normal copy), the process advances to step S1205.

In step S1202, the applied toner amount detection unit 311 determines, based on the setting information received from the operation unit 323, whether the image composition to be executed is the "entire image composition" or the "transparent image composition". For the entire image composition, the process advances to step S1203 to perform the same control as in the first embodiment. For transparent image composition, the process advances to step S1205 to perform applied toner amount detection processing for the composite image. Steps S1203 to S1207 are the same as steps S702 to S706 of FIG. 7, and a description thereof will be omitted.

As described above, according to the second embodiment, when performing image composition by transparent image composition, control is performed so as to execute applied toner amount detection processing of the composite image. This makes it possible to prevent inappropriate temperature control that may occur in transparent image composition.

Third Embodiment

In the third embodiment, more suitable fixing temperature control when performing "transparent image composition"

will be described. In the method according to the above-described second embodiment, applied toner amount detection processing is always performed in transparent image composition. It is therefore impossible to reduce the processing load of applied toner amount detection processing in transparent image composition. Fixing temperature control capable of reducing the processing load even in transparent image composition will be described below.

Note that the system configuration and the arrangement of the image forming apparatus are the same as in the first embodiment (FIGS. 1 to 3), and a description thereof will be omitted. Operations of the image forming apparatus different from the first embodiment will mainly be explained below.

Operation of Image Forming Apparatus

Processing for causing a controller unit 301 to store a form image to be used in the image composition function is the same as in the first embodiment (FIG. 5), and a description thereof will be omitted. Processing for causing the controller unit 301 to notify a print unit 302 of print image data and applied toner amount information is the same as in the first embodiment (FIG. 8), and a description thereof will be omitted. Fixing unit temperature control by the print unit is the same as in the first embodiment (FIG. 9), and a description thereof will be omitted. Processing up to spool processing of print image data by the controller unit 301 is the same as in the first embodiment (FIG. 6) except applied toner amount detection processing of step S609, and a description thereof will be omitted.

Figure 13:
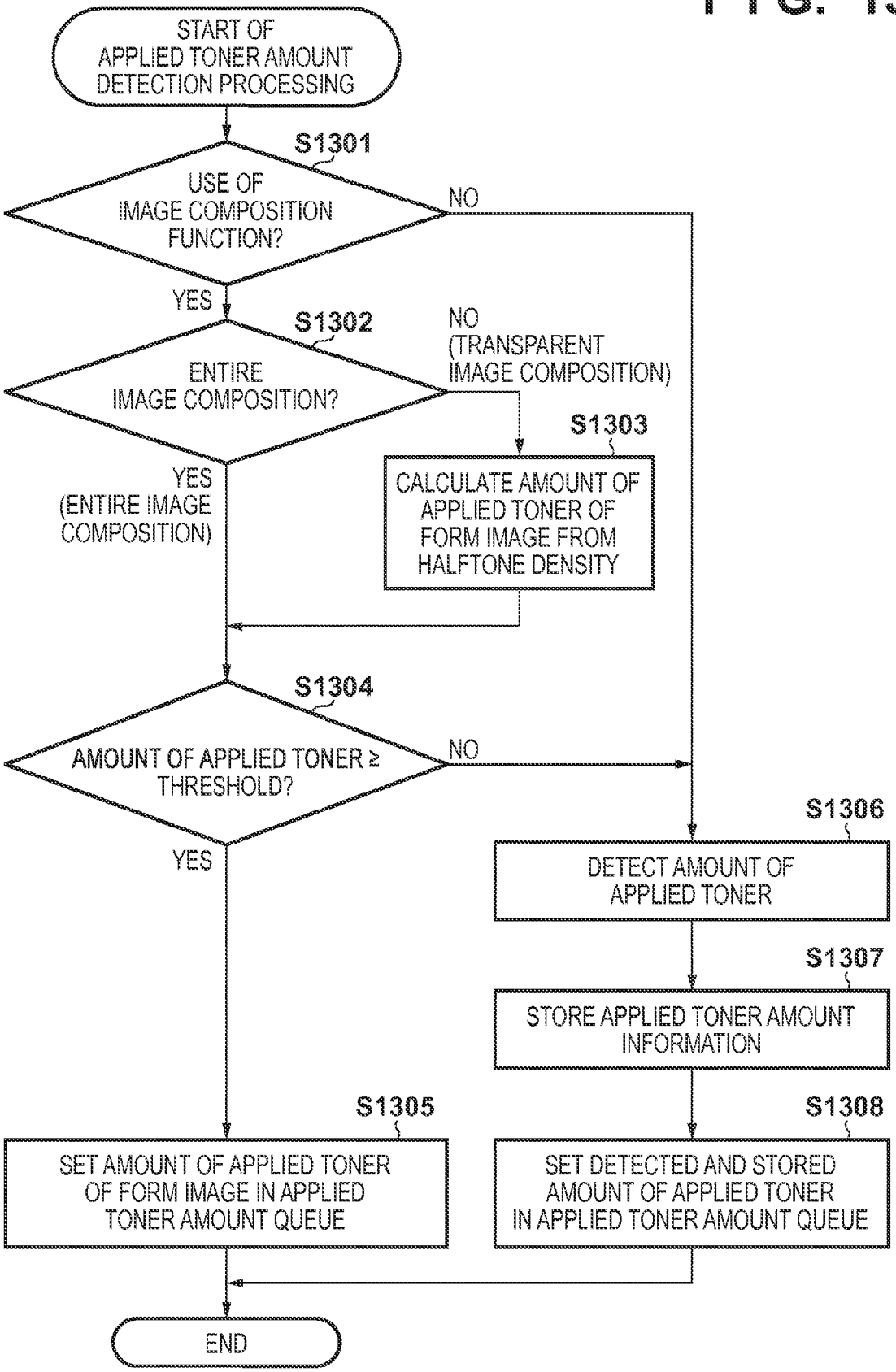
FIG. 13 is a flowchart of applied toner amount detection processing according to the second embodiment.

FIG. 13 is a flowchart of applied toner amount detection processing according to the third embodiment. Note that the procedure shown in FIG. 13 is implemented by causing the CPU 304 to execute a control program and operate an applied toner amount detection unit 311. Steps S1301 and S1302 are the same as steps S1201 and S1202 of FIG. 12, respectively, and a description thereof will be omitted.

Upon determining in step S1302 to perform transparent image composition, in step S1303, the applied toner amount detection unit 311 calculates the amount of applied toner based on the value of the halftone density in transparent image composition and the amount of applied toner of the form image. That is, the applied toner amount detection unit 311 calculates the amount of applied toner after transparent image composition from data based on the value of the halftone density received from the operation unit and the amount of applied toner of the form image. This calculation can be performed by a method of normalizing and storing the relationship between the halftone density set value and a change in the amount of applied toner corresponding to it or a method of holding, as a table, CMYK toner amounts and the value of the amount of applied toner by a halftone density and performing conversion processing of the amount of applied toner.

Upon determining in step S1302 to perform entire image composition, the applied toner amount detection unit 311 determines in step S1304 whether the amount of applied toner of the form image to be used is equal to or larger than a threshold. On the other hand, in transparent image composition, the applied toner amount detection unit 311 determines whether the amount of applied toner calculated in step S1303 is equal to or larger than the threshold. Upon determining that the amount of applied toner is equal to or larger than the threshold, the process advances to step S1305. Upon determining that the amount of applied toner is smaller than the threshold, the process advances to step S1306. Steps S1305 to S1308 are the same as steps S703 to S706 of FIG. 7, and a description thereof will be omitted.

As described above, according to the third embodiment, when performing transparent image composition, the amount of applied toner is calculated based on the value of the halftone density in transparent image composition and the amount of applied toner of the form image instead of performing applied toner amount detection processing of the composite image of a heavy processing load. This makes it possible to reduce the processing load even in transparent image composition.

Fourth Embodiment

In the fourth embodiment, more appropriate fixing temperature adjustment in a case where image composition by entire image composition is performed, and the amount of applied toner of a form image is smaller than a threshold will be described. In entire image composition, at a portion of an original image that overlaps a region of the form image other than its background region, where a character or an image exists, the original image is overwritten by the form image and becomes invisible. Since the amount of applied toner of this region is included in the amount of applied toner of the form image, applied toner amount detection processing need not be performed anew. That is, in this case, performing applied toner amount detection processing only for the region of the original image (that is, region that is not overwritten by the form image) overlapping the background region of the form image suffices. A form of performing applied toner amount detection processing for the minimum necessary region will be described below.

Note that the system configuration and the arrangement of the image forming apparatus are the same as in the first embodiment (FIGS. 1 to 3), and a description thereof will be omitted. Operations of the image forming apparatus different from the first embodiment will mainly be explained below.

Operation of Image Forming Apparatus

Processing for causing a controller unit 301 to notify a print unit 302 of print image data and applied toner amount information is the same as in the first embodiment (FIG. 8), and a description thereof will be omitted. Fixing unit temperature control by the print unit is the same as in the first embodiment (FIG. 9), and a description thereof will be omitted.

Figure 14:
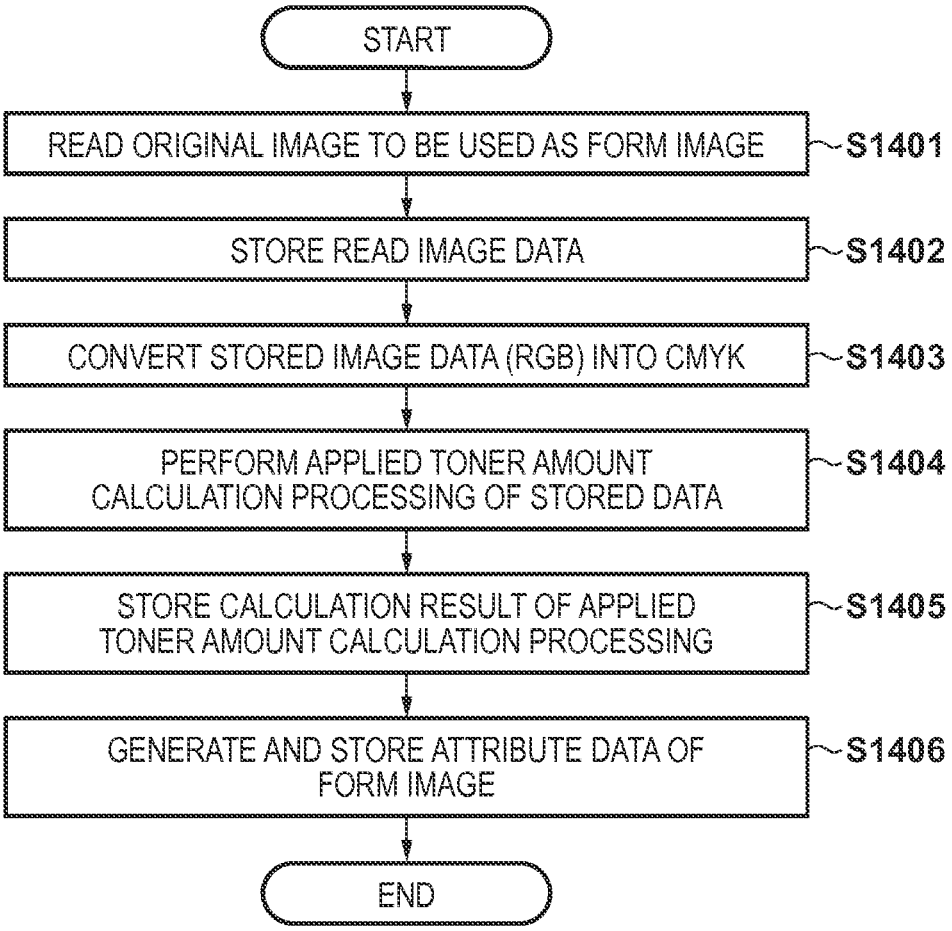
FIG. 14 is a flowchart of form image generation processing according to the fourth embodiment.

FIG. 14 is a flowchart of form image generation processing according to the fourth embodiment. Note that the procedure shown in FIG. 14 is implemented by causing the CPU 304 to execute a control program and operate an image processing unit 308. Note that steps S1401 to S1405 are the same as steps S501 to S505 of FIG. 5, and a description thereof will be omitted.

In step S1406, an attribute data detection processing unit 326 performs attribute data detection processing for the stored form image (attribute detection unit). The detection result is stored in a storage unit 307 as attribute data.

Processing up to spool processing of print image data by the controller unit 301 is the same as in FIG. 6 except applied toner amount detection processing of step S609, and a description thereof will be omitted.

Figure 15:
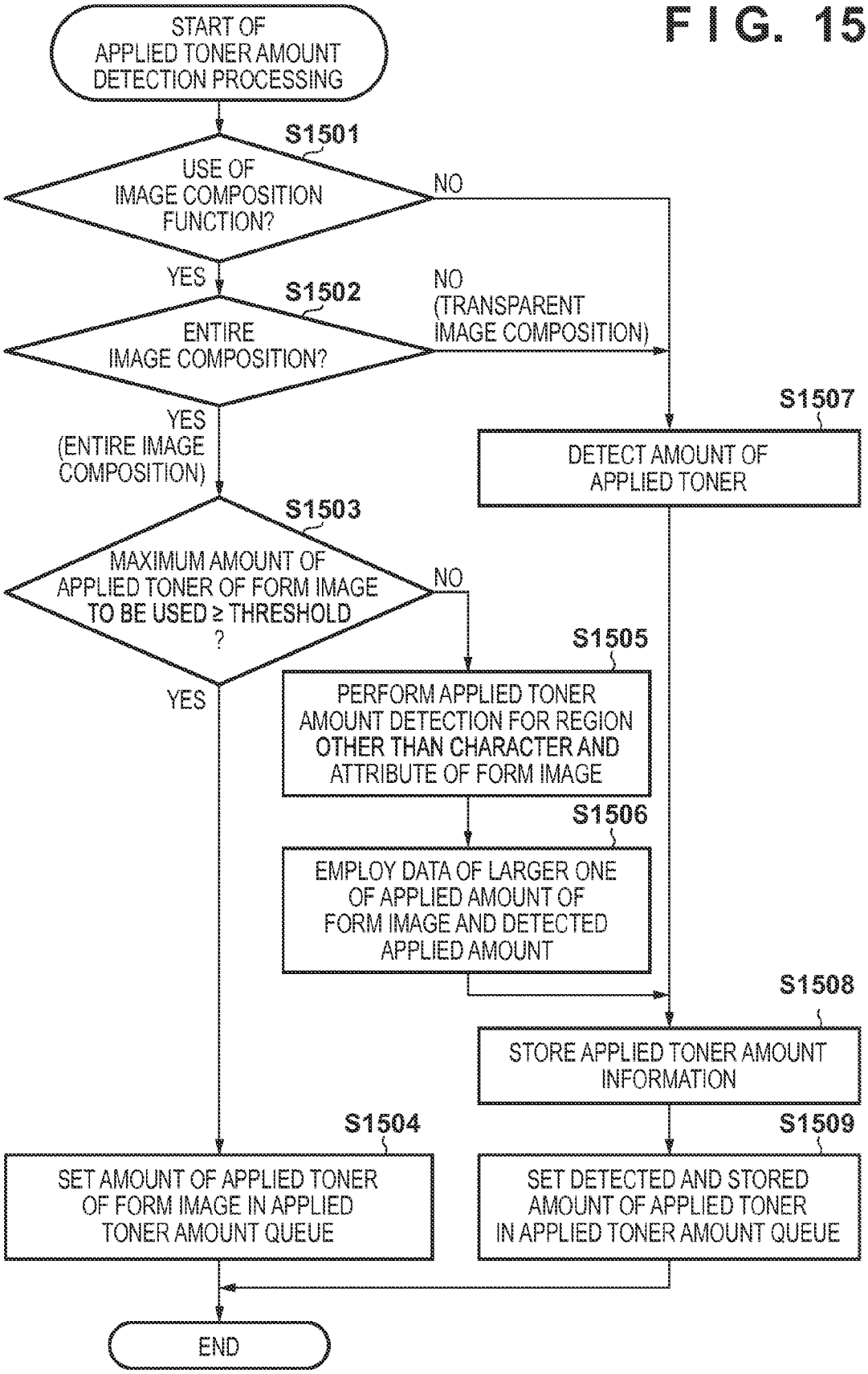
FIG. 15 is a flowchart of applied toner amount detection processing according to the fourth embodiment.

FIG. 15 is a flowchart of applied toner amount detection processing according to the fourth embodiment. Note that the procedure shown in FIG. 15 is implemented by causing the CPU 304 to execute a control program and operate an applied toner amount detection unit 311. Steps S1501 and S1502 are the same as steps S1201 and S1202 of FIG. 12, and a description thereof will be omitted.

In step S1503, the applied toner amount detection unit 311 determines whether the amount of applied toner of the form image to be used is equal to or larger than a threshold. Upon determining that the amount of applied toner is equal to or larger than the threshold, the process advances to step S1504. Upon determining that the amount of applied toner is smaller than the threshold, the process advances to step S1505. Step S1504 is the same as step S703 of FIG. 7, and a description thereof will be omitted.

In step S1505, the applied toner amount detection unit 311 receives, from the storage unit 307, the attribute data of the form image to be used. Based on the received attribute data, applied toner amount detection processing is performed only for regions whose attribute data represents the background of the form image out of the regions of the original image.

In step S1506, the applied toner amount detection unit 311 receives, from the storage unit 307, the amount of applied toner of the form image to be used. Out of the received applied toner amount information and the applied toner amount information calculated in step S1505, data of the larger amount of applied toner is employed as the applied toner amount information of the page. Steps S1507 to S1509 are the same as steps S704 to S706 of FIG. 7, and a description thereof will be omitted.

As described above, according to the fourth embodiment, when image composition by entire image composition is performed, and the amount of applied toner of the form image is smaller than the threshold, applied toner amount detection processing is executed for the minimum necessary region. This makes it possible to implement more appropriate fixing temperature adjustment.

Other Embodiments

Embodiment(s) of the present invention can also be realized by a computer of a system or an apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-043154, filed Mar. 5, 2014 which is hereby incorporated by reference herein in its entirety.

What is claimed is:

1. An image forming apparatus of an electrophotographic type, comprising:

an image composition unit configured to compose an input image and a form image and generate a composite image;

a determination unit configured to determine whether the image composition processing by said image composition unit is designated;

a threshold determination unit configured to determine whether the maximum amount of applied toner of the form image is not less than a predetermined threshold;

a setting unit configured to set the amount of applied toner of the form image as the amount of applied toner of the composite image if said determination unit determines that the image composition processing by said image composition unit is designated, and said threshold determination unit determines that the maximum amount of applied toner of the form image is not less than the predetermined threshold; and a control unit configured to control, based on a fixing temperature that is determined based on the amount of applied toner set by said setting unit, the fixing temperature when performing fixing processing for a printing medium with a toner image that is formed based on the composite image.

2. The apparatus according to claim 1, further comprising a storage unit configured to store the amount of applied toner of the form image, wherein said setting unit sets the amount of applied toner of the form image stored in said storage unit as the amount of applied toner of the composite image if said determination unit determines that image composition processing by said image composition unit is designated, and said threshold determination unit determines that the maximum amount of applied toner of the form image is not less than the predetermined threshold.

3. The apparatus according to claim 1, further comprising a detection unit configured to detect the amount of applied toner from one of the input image and the composite image, wherein said setting unit sets the amount of applied toner of the input image detected by said detection unit as the amount of applied toner if said determination unit determines that image composition processing by said image composition unit is not designated, and sets the amount of applied toner of the composite image detected by said detection unit as the amount of applied toner if said determination unit determines that image composition processing by said image composition unit is designated, and said threshold determination unit determines that the maximum amount of applied toner of the form image is less than the predetermined threshold, and said control unit controls, based on the fixing temperature that is determined based on the amount of applied toner set by said setting unit, the fixing temperature when performing fixing processing for the printing medium with a toner image that is formed based on the input image if said determination unit determines that image composition processing by said image composition unit is not designated, and controls, based on the fixing temperature that is determined based on the amount of applied toner set by said setting unit, the fixing temperature when performing fixing processing for the printing medium with the toner image that is formed based on the composite image if said determination unit determines that image composition processing by said image composition unit is designated, and said threshold determination unit determines that the maximum amount of applied toner of the form image is less than the predetermined threshold.

4. The apparatus according to claim 3, wherein said setting unit sets the amount of applied toner of the composite image detected by said detection unit as the amount of applied toner if said determination unit determines that image composition processing by said image composition unit is designated, and a transparent image composition that composes the form image through which the input image is visible is designated as the image composition processing, and said control unit controls, based on the fixing temperature that is determined based on the amount of applied toner set by said setting unit, the fixing temperature when performing fixing processing for the printing medium with the toner image that is formed based on the composite image if said determination unit determines that image composition processing by said image composition unit is designated, and the transparent image composition that composes the form image through which the input image is visible is designated as the image composition processing.

5. The apparatus according to claim 3, wherein said setting unit sets an amount of applied toner that is calculated based on a halftone density in a transparent image composition that composes the form image through which the input image is visible and the amount of applied toner of the form image as the amount of applied toner if said determination unit determines that image composition processing by said image composition unit is designated, and the transparent image composition that composes the form image through which the input image is visible is designated as the image composition processing, and said control unit controls, based on the fixing temperature that is determined based on the amount of applied toner set by said setting unit, the fixing temperature when performing fixing processing for the printing medium with the toner image formed based on the composite image if said determination unit determines that the image composition processing by said image composition unit is designated, and the transparent image composition that composes the form image through which the input image is visible is designated as the image composition processing.

6. The apparatus according to claim 3, further comprising an attribute detection unit configured to perform attribute detection of each region of the form image, wherein said detection unit detects the amount of applied toner only in a region of the input image corresponding to a region of the form image detected by said attribute detection unit as a background region if said determination unit determines that the image composition processing by said image composition unit is designated, and said threshold determination unit determines that the maximum amount of applied toner of the form image is less than the predetermined threshold, and said setting unit sets a larger one of the amount of applied toner detected by said detection unit and the amount of applied toner of the form image as the amount of applied toner of the composite image.

7. A control apparatus for controlling an image forming apparatus of an electrophotographic type, comprising:

an image composition unit configured to compose an input image and a form image and generate a composite image;

a determination unit configured to determine whether the image composition processing by said image composition unit is designated;

a threshold determination unit configured to determine whether the maximum amount of applied toner of the form image is not less than a predetermined threshold;

a setting unit configured to set an amount of applied toner of the form image as the amount of applied toner of the composite image if said determination unit determines that the image composition processing by said image composition unit is designated, and said threshold determination unit determines that the maximum amount of applied toner of the form image is not less than the predetermined threshold; and an output unit configured to output, to the image forming apparatus, image data obtained by halftone processing of the composite image and a fixing temperature that is determined based on the amount of applied toner set by said setting unit.

8. The apparatus according to claim 7, further comprising a detection unit configured to detect the amount of applied toner from one of the input image and the composite image, wherein said setting unit sets the amount of applied toner of the input image detected by said detection unit as the amount of applied toner if said determination unit determines that the image composition processing by said image composition unit is not designated, and sets the amount of applied toner of the composite image detected by said detection unit as the amount of applied toner if said determination unit determines that the image composition processing by said image composition unit is designated, and said threshold determination unit determines that the maximum amount of applied toner of the form image is less than the predetermined threshold, and said output unit outputs, to the image forming apparatus, image data obtained by halftone processing of the input image and the fixing temperature that is determined based on the amount of applied toner set by said setting unit if said determination unit determines that the image composition processing by said image composition unit is not designated, and said output unit outputs, to the image forming apparatus, the image data obtained by halftone processing of the composite image and the fixing temperature that is determined based on the amount of applied toner set by said setting unit if said determination unit determines that the image composition processing by said image composition unit is designated, and said threshold determination unit determines that the maximum amount of applied toner of the form image is less than the predetermined threshold.

9. A control method of an image forming apparatus of an electrophotographic type, the image forming apparatus having an image composition function of composing an input image and a form image and generating a composite image, the method comprising:

determining whether the image composition processing by the image composition function is designated;

determining whether the maximum amount of applied toner of the form image is not less than a predetermined threshold;

setting an amount of applied toner of the form image as the amount of applied toner of the composite image if it is determined in the determining step, determining whether the image composition processing by the image composition function is designated, that the image composition processing by the image composition function is designated, and it is determined in the determining step, determining whether the maximum amount of applied toner of the form image is not less than the predetermined threshold, that the maximum amount of applied toner of the form image is not less than the predetermined threshold; and controlling, based on a fixing temperature that is determined based on the amount of applied toner set in the setting step, the fixing temperature when performing fixing processing for a printing medium with a toner image that is formed based on the composite image.

10. A control method of a control apparatus for controlling an image forming apparatus of an electrophotographic type, the control apparatus having an image composition function of composing an input image and a form image and generating a composite image, the method comprising:

determining whether the image composition processing by the image composition function is designated;

determining whether the maximum amount of applied toner of the form image is not less than a predetermined threshold;

setting an amount of applied toner of the form image as the amount of applied toner of the composite image if it is determined in the determining step, determining whether the image composition processing by the image composition function is designated, that the image composition processing by the image composition function is designated, and it is determined in the determining step, determining whether the maximum amount of applied toner of the form image is not less than the predetermined threshold, that the maximum amount of applied toner of the form image is not less than the predetermined threshold; and outputting, to the image forming apparatus, image data obtained by halftone processing of the composite image and a fixing temperature that is determined based on the amount of applied toner set in the setting step.

11. A non-transitory computer-readable recording medium storing a program that causes a computer to function as each of the units of the image forming apparatus according to claim 1.

* * * * *